US009808038B2

(12) United States Patent
Long

(10) Patent No.: US 9,808,038 B2
(45) Date of Patent: Nov. 7, 2017

(54) BATTING GLOVE WITH INTERNAL SLIP LAYER

(71) Applicant: EASTON BASEBALL / SOFTBALL INC., Van Nuys, CA (US)

(72) Inventor: Keenan Long, Sherman Oaks, CA (US)

(73) Assignee: EASTON DIAMOND SPORTS LLC, Thousand Oaks, CA (US)

( * ) Notice: Subject to any disclaimer, the term of this patent is extended or adjusted under 35 U.S.C. 154(b) by 160 days.

(21) Appl. No.: 14/975,261

(22) Filed: Dec. 18, 2015

(65) Prior Publication Data

US 2017/0172231 A1 Jun. 22, 2017

(51) Int. Cl.
*A41D 13/015* (2006.01)
*A41D 19/00* (2006.01)
(Continued)

(52) U.S. Cl.
CPC ... *A41D 19/0006* (2013.01); *A41D 19/01523* (2013.01); *A41D 19/01547* (2013.01); *A63B 71/141* (2013.01)

(58) Field of Classification Search
CPC ..... A41D 19/01523; A41D 19/01558; A41D 19/0006; A41D 19/015; A41D 19/00; A41D 19/001; A41D 13/082; A41D 13/081; A41D 19/01547; A41D 19/01564; A41D 2600/104; A41D 13/015; A41D 13/084; A41D 19/0055; A41D 19/0058; A41D 19/0068; A41D 2400/80; A41D 2600/10; A63B 71/141; A63B 71/143; A63B 71/146; A63B 71/148; A63B 2243/0025; A63B 2102/182; A63B 2102/32; A63B 60/14; A63B 2102/14; A63B 2102/22; A63B 21/4019; A63B 60/08; B32B 7/02
See application file for complete search history.

(56) References Cited

U.S. PATENT DOCUMENTS 1,690,312 A 11/1928 Rosan
2,084,428 A * 6/1937 Bush ..... A63B 71/146 2/159

(Continued)

FOREIGN PATENT DOCUMENTS

JP 4870310 B2 2/2012

OTHER PUBLICATIONS

Sorbathane, "The Difference Between Elastic Materials and Viscoelastic Materials," http://www.sorbothane.com/the-difference-between-elastic-materials-and-viscoelastic-materials.aspx, 3 pgs, Aug. 31, 2016.

(Continued)

*Primary Examiner* — Bobby Muromoto, Jr.
(74) *Attorney, Agent, or Firm* — Perkins Coie LLP

(57) ABSTRACT

A batting glove or sports glove includes a glove base configured to accommodate a users hand. In some embodiments, the glove base has an opening in a palmar region of the glove. Multiple palmar layers are attached to the glove base and positioned over the opening. In some embodiments, the palmar layers include a first layer of material positioned between a second layer of material and a third layer of material. The first layer of material has a lower coefficient of friction than one or both of the second and third layers of material such that the layers may slide relative to one another.

20 Claims, 2 Drawing Sheets

(51) Int. Cl.
*A63B 71/14* (2006.01)
*A41D 19/015* (2006.01)

(56) References Cited

U.S. PATENT DOCUMENTS 2,242,318 A * 5/1941 Mosier ..... A41D 19/00 2/159
4,461,043 A 7/1984 Lomedico et al.
4,561,122 A * 12/1985 Stanley ..... A41D 19/015 2/161.1
4,571,960 A * 2/1986 Hursh ..... A41B 11/005 2/239
4,691,387 A * 9/1987 Lopez ..... A41D 19/01547 2/159
4,754,499 A * 7/1988 Pirie ..... A41D 13/082 2/20
4,815,147 A 3/1989 Gazzano et al.
4,881,276 A * 11/1989 Swan ..... A41D 19/01529 2/161.1
4,892,315 A * 1/1990 Iorlano ..... A63B 53/14 2/161.2
5,081,715 A * 1/1992 Mascia ..... A41D 13/082 2/20
5,180,165 A 1/1993 Frost
5,218,719 A * 6/1993 Johnson ..... A63B 71/146 2/161.1
5,257,418 A 11/1993 Jaskiewicz
5,322,286 A * 6/1994 Frost ..... A63B 60/06 2/20
5,467,484 A * 11/1995 Drescher ..... A41D 19/01547 2/161.6
5,500,956 A * 3/1996 Schulkin ..... A63B 71/148 2/159
5,557,803 A * 9/1996 Granich ..... A41D 19/01523 2/16
5,588,651 A 12/1996 Frost
5,590,420 A 1/1997 Gunn
5,640,712 A 6/1997 Hansen et al.
5,704,845 A 1/1998 Boyte et al.
5,758,365 A 6/1998 Steeley et al.
5,790,980 A 8/1998 Yewer et al.
5,806,091 A 9/1998 McHugh et al.
5,815,838 A 10/1998 Lord et al.
5,896,584 A 4/1999 Hauser
5,898,938 A 5/1999 Baylor et al.
5,987,642 A 11/1999 Webster et al.
5,987,646 A 11/1999 Bolmer
6,024,712 A 2/2000 Iglesias et al.
6,098,200 A 8/2000 Minkow et al.
6,099,936 A * 8/2000 Kashihara ..... A41D 19/01558 2/159
6,260,198 B1 7/2001 LoMedico et al.
6,389,596 B2 5/2002 LoMedico et al.
6,427,246 B1 8/2002 Doi et al.
6,557,177 B2 5/2003 Hochmuth
6,721,960 B1 4/2004 Levesque et al.
6,799,329 B2 10/2004 LoMedico et al.
6,996,849 B2 2/2006 LoMedico et al.
7,179,180 B1 2/2007 Frost et al.
7,484,248 B2 2/2009 Lomedico et al.
7,895,669 B2 3/2011 Kleinert et al.
8,104,098 B1 1/2012 Kleinert et al.
8,256,028 B1 9/2012 Ibon et al.
8,261,372 B2 9/2012 Drab et al.
8,490,215 B2 7/2013 Mueller et al.
8,602,925 B1 12/2013 Rickon et al.
8,813,262 B2 8/2014 Pechtold et al.
8,839,462 B2 9/2014 Webster et al.
9,032,553 B2 * 5/2015 Bevier ..... A63B 71/141 2/161.3
9,155,349 B2 10/2015 Madore et al.
9,155,951 B2 10/2015 Ahern et al.
2001/0053421 A1 * 12/2001 Schaller ..... A41D 19/0058 427/557
2002/0116743 A1 * 8/2002 Tourbier ..... A41D 19/015 2/160
2003/0070209 A1 * 4/2003 Falone ..... A41D 13/015 2/412
2004/0123373 A1 * 7/2004 Yamada ..... A41D 19/01558 2/161.2
2005/0002995 A1 * 1/2005 Schaller ..... A41D 19/0058 424/443
2005/0229286 A1 * 10/2005 Tseng ..... A41D 19/01564 2/161.2
2006/0026738 A1 * 2/2006 Kleinert ..... A41D 19/015 2/163
2006/0068138 A1 * 3/2006 Janssen ..... A41D 19/0055 428/35.7
2007/0028356 A1 * 2/2007 Cabauy ..... A41D 19/01558 2/161.6
2007/0261149 A1 11/2007 Gait
2008/0034466 A1 * 2/2008 Zicarelli ..... A43B 23/07 2/158
2009/0025120 A1 * 1/2009 Vestling ..... A41D 19/015 2/161.1
2009/0038051 A1 * 2/2009 Fujihana ..... A41D 19/01558 2/161.8
2009/0042660 A1 2/2009 Shaw et al.
2011/0047670 A1 3/2011 Anderson et al.
2011/0265239 A1 * 11/2011 Kanemitsu ..... A41D 19/01523 2/19
2012/0005805 A1 * 1/2012 Bevier ..... A63B 71/141 2/161.1
2012/0324623 A1 * 12/2012 Cabauy ..... A41D 19/01558 2/167
2013/0007937 A1 * 1/2013 Stone ..... A41D 13/081 2/16
2013/0014307 A1 * 1/2013 Lee ..... A41D 19/01564 2/20
2013/0036528 A1 * 2/2013 Wilson ..... A41D 19/0034 2/160
2013/0067635 A1 * 3/2013 Lin ..... A41D 19/0068 2/161.6
2013/0333093 A1 * 12/2013 Storelli ..... A41D 19/01523 2/161.1
2014/0215685 A1 * 8/2014 Bush ..... A41D 19/01523 2/161.1
2015/0164157 A1 * 6/2015 Garneau ..... A41D 19/015 2/160
2015/0272242 A1 * 10/2015 Bevier ..... A63B 71/141 2/20
2015/0305415 A1 * 10/2015 Stone ..... A41D 13/081 2/16
2015/0305416 A1 * 10/2015 Chorne ..... A63B 71/143 2/16
2015/0367210 A1 * 12/2015 Long ..... A63B 71/141 473/568
2017/0014697 A1 * 1/2017 Long ..... A63B 71/141

OTHER PUBLICATIONS

Teachengineering, Integrated Teaching and Learning Program, College of Engineering, University of Colorado Boulder, "Lesson: Viscoelasticity," https://www.teachengineering.org/lessons/view/cub_surg_lesson04, 8 pgs, 2011.

Evoshield, "Baseball Catcher's Thumb Guard", http://www.evoshield.com/shop/on-field-gear/protective-gear/wrist-hand-protection/evoshield-baseball-catcher-s-thumb-guard, publication date unknown, viewed Aug. 31, 2016.

Evoshield, "Prostyle Protective Batting Gloves", http://www.evoshield.com/shop/on-field-gear/protective-gear/wrist-hand-protection/evoshield-prostyle-protective-batting-gloves, publication date unknown, viewed Aug. 31, 2016.

U.S., Search Report and Written Opinion for PCT/US16/65538, 7 pgs, dated Feb. 21, 2017.

* cited by examiner

BATTING GLOVE WITH INTERNAL SLIP LAYER

BACKGROUND

A baseball or softball batter typically swings a bat several times during a game or in practice or training. During a batter's swing, rapid acceleration and deceleration of the barrel, along with vibrations from impact with a ball, result in strong forces that can damage the fibrous connective tissues, muscles, tendons, and ligaments of the batter's hands, and can cause blisters, callouses, bruises, open wounds, and even broken bones in the hand.

Many batters wear a thin batting glove on one or both hands to try to reduce damage to their hands during a swing. But motion of the bat is still transferred through the glove into the user's hand because the hand, the glove, and the bat are all directly connected. As a result, standard thin batting gloves do not always provide adequate protection for a batter's hands.

Other batters choose to wear a thick or padded batting glove on one or both hands. The thickness or padding of the glove acts as more of a barrier or damper to forces from each swing. But the hand, the glove, and the bat remain directly connected. And the thickness or padding reduces a player's tactile gnosis, which is a cognizance-by-touch form of sensory perception. Successful athletes use tactile gnosis to relate to their equipment as an extension of their own bodies. Thick or padded gloves distance the user from the bat and reduce a batter's ability to accurately feel and control a swing. Because of these disadvantages, professional and elite batters rarely use thick or padded gloves.

SUMMARY

A batting glove or sports glove includes a glove base configured to accommodate a user's hand. In some embodiments, the glove base has an opening in a palmar region of the glove. Multiple palmar layers are attached to the glove base and positioned over the opening. In some embodiments, the palmar layers include a first layer of material positioned between a second layer of material and a third layer of material. The first layer of material has a lower coefficient of friction than one or both of the second and third layers of material such that the layers may slide relative to one another. Other features and advantages will appear hereinafter. The features described above may be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to a batting glove with an internal slip layer. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, the technology may include other embodiments with additional elements or without several of the elements described below with reference to FIGS. 1-2, which illustrate examples of the technology.

The terminology used in the description presented below is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sports or industries in which hand protection and a high level of tactile gnosis is advantageous or desirable.

Figure 1:
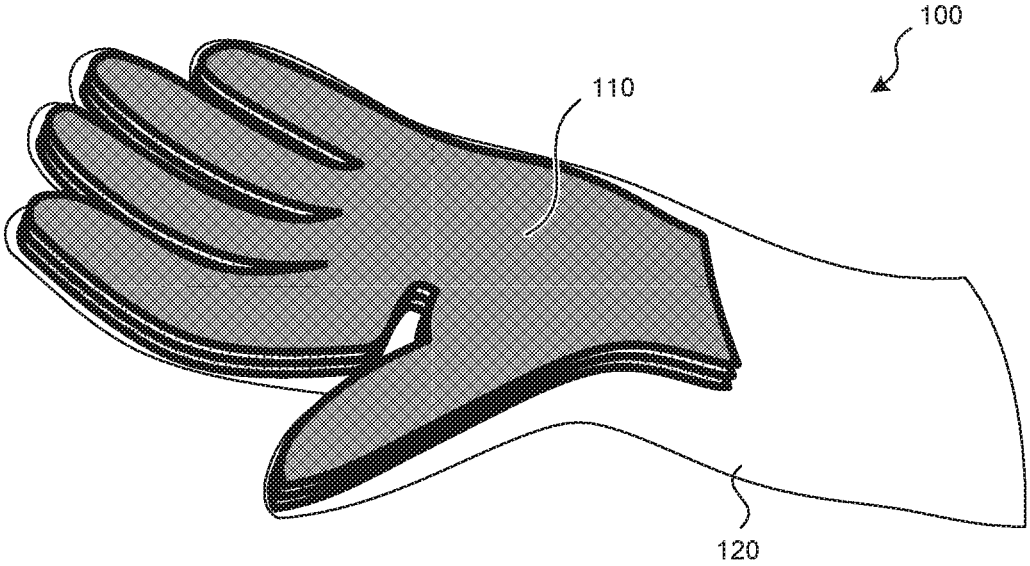
FIG. 1 is a schematic perspective view of a glove assembly in accordance with an embodiment of the technology.

FIG. 1 illustrates a glove assembly 100 in accordance with an embodiment of the technology. A palmar component 110 is stitched, glued, or otherwise suitably secured to or integrated with a glove base 120. The palmar component 110 may be shaped to generally correspond with the palmar surface of a user's hand, including the surfaces of a user's fingers, or it may be otherwise suitably shaped to provide protection to other desired regions of the user's hand. For example, the palmar component 110 may be shaped to correspond with areas of the glove assembly 100 that contact sports equipment (for example, a ball bat) when in use. The glove base 120 may be shaped to accommodate a user's left or right hand. The glove base 120 may be formed from natural leather, synthetic leather, sheepskin, goatskin, microfiber, or other materials suitable for athletic use. The palmar component 110 may be formed from a stack of layers, as described below with reference to FIG. 2.

Figure 2:
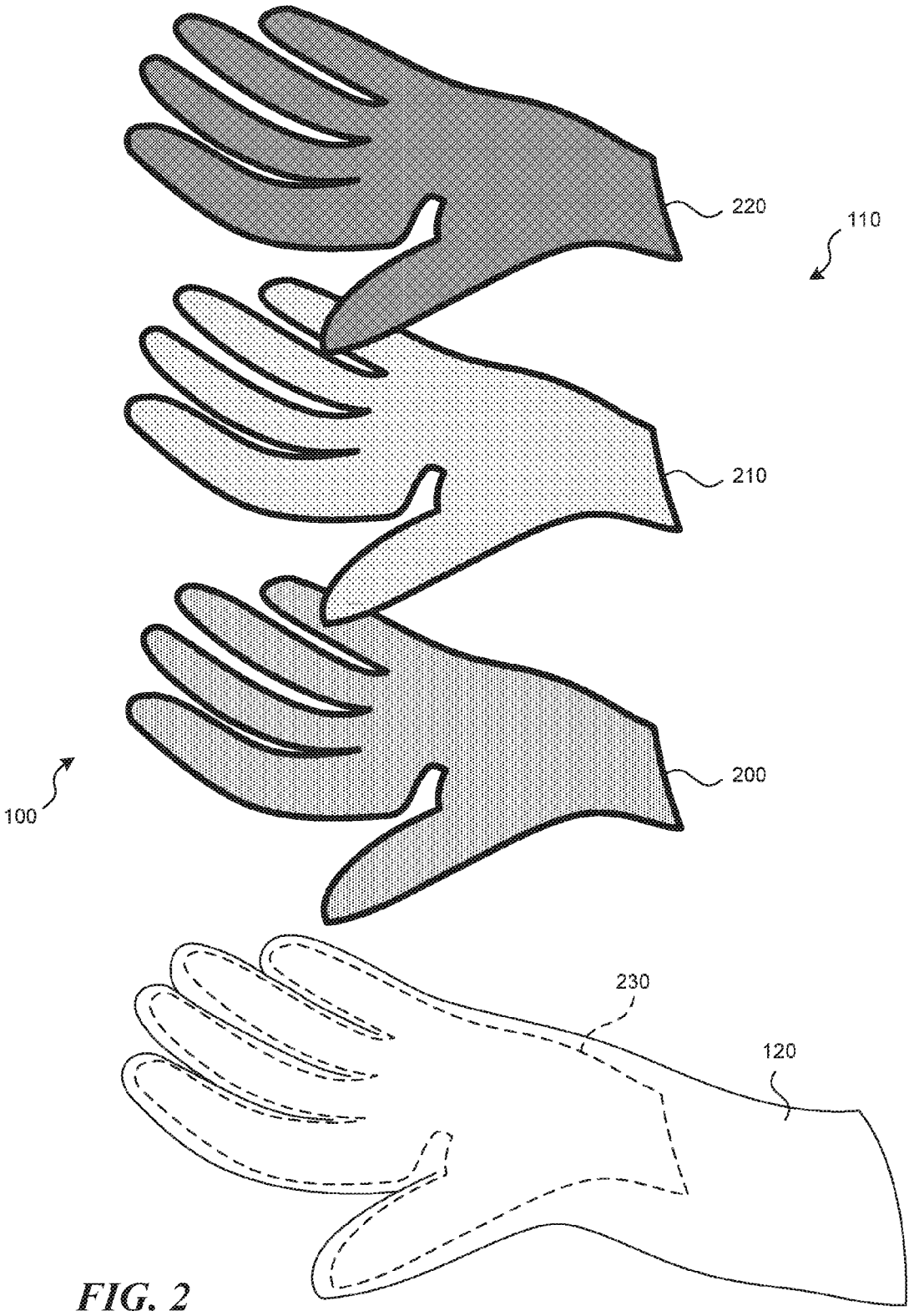
FIG. 2 is an exploded schematic view of the glove illustrated in FIG. 1.

FIG. 2 illustrates a stack of layers forming the palmar component 110, according to one embodiment. The palmar component 110 includes an inner layer 200, a release ply layer 210, and an outer layer 220. The layers 200, 210, 220 of the palmar component 110 may be stitched, glued, or otherwise connected together around their respective perimeters to form the palmar component 110, which is mounted in the glove base 120. In some embodiments, the assembled palmar component 110 may be stitched, glued, or otherwise secured into a correspondingly-shaped opening 230 or receiving area in the glove base 120.

In other embodiments, the inner layer 200 may be formed as an integral part of the glove base 120. In other words, in some embodiments, the glove base 120 need not have an opening 230, and the inner layer 200 need not be a discrete part of the palmar component 110. In such embodiments, the release ply layer 210 and the outer layer 220 are stitched, glued, or otherwise connected along their respective perimeters to the glove base 120.

In some embodiments, the layers 200, 210, 220 may include stitching, glue, or another attachment along their respective perimeters, while lacking attachment in some interior regions of the layers. For example, in some embodiments, there may be an absence of attachment adjacent to a proximal portion of the palmar surface, a distal portion of the palmar surface, a lateral portion of the palmar surface (for example, a thenar or thenar eminence region of the palmar surface), a medial portion of the palmar surface (for example, a hypothenar or hypothenar eminence region of the palmar surface), or some or all of a digital region (i.e., fingers). In some embodiments, in addition to stitching or another attachment in perimeter regions of the layers 200, 210, 220, there may be stitching or another attachment at the base of one or more finger regions.

The inner layer 200 and the outer layer 220 may be formed from various materials, including materials generally used in sports or batting gloves. For example, the inner layer 200 and the outer layer 220 may be formed from natural leather, synthetic leather, sheepskin, goatskin, microfiber, or other materials suitable for athletic or industrial use. In some embodiments, the inner layer 200 and the outer layer 220 may be formed from the same material, or in other embodiments, they may be formed from different materials.

The release ply layer 210 may be formed from a thin film or other material having low friction or a low coefficient of friction. In particular embodiments, the release ply layer 210 has a lower coefficient of friction than either or both of the inner layer 200 and the outer layer 220. For example, in some embodiments, the release ply layer 210 may be 0.002 inches thick and formed from polyethylene film. In other embodiments, other suitable thicknesses and materials may be used, such as polyester film (for example, MYLAR) or fiberglass cloth coated or impregnated with a polymer such as PTFE (for example, TEFLON).

In use, a ball bat or other implement tends to frictionally engage the outer layer 220, while the skin of the user's hand tends to frictionally engage the inner layer 200. The release ply layer 210 allows all of the layers 200, 210, 220 to slide with respect to one another, thus providing a slip plane to divert energy and forces from the bat handle. The layers 200, 210, 220 decouple the bat from the hand along the slip plane so that short forceful impulses and motions of the bat handle and knob are prevented, or substantially prevented, from passing through the glove into the hand.

In some embodiments of the present technology, the layers 200, 210, 220 may be generally similar in size. In other embodiments, the layers 200, 210, 220 may have relatively different sizes among themselves in order to resist bunching or wrinkling of the layers when a user grasps a bat. For example, the outer layer 220 may be smaller (for example, proportionally smaller) than the release ply layer 210, and the release ply layer 210 may be smaller (for example, proportionally smaller) than the inner layer 200. In such embodiments, the layers 200, 210, 220 may still be stitched or otherwise attached around their respective perimeters or in other areas as described above. And in such embodiments, the inner layer 200 may be sized such that a degree of looseness or slack exists in the inner layer 200 when the user's palm is open, but the looseness or slack tightens when the user grips the round handle of a bat.

In contrast with existing gloves that absorb energy through padding or increased thickness, the current technology uses thin slipping layers to divert energy along the slip plane without unduly limiting feel or tactile gnosis. Thus, when a user grasps the bat, the palmar component 110 generally feels like one thin layer. Accordingly, the present technology provides a safe batting glove without unduly limiting feel.

From the foregoing, it will be appreciated that specific embodiments of the disclosed technology have been described for purposes of illustration, but that various modifications may be made without deviating from the technology, and elements of certain embodiments may be interchanged with those of other embodiments. For example, in some alternative embodiments, there may be more than one release ply layer (for example, 210). In some embodiments, the stitching, gluing, or other attachment between the layers 200, 210, 220 or the glove base 120 may be located in areas other than the perimeters of the layers.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A glove comprising:

a glove base configured to accommodate a user's hand, the glove base having an opening in a palmar region; and a plurality of layers retained in the palmar region and positioned over the opening, the plurality of layers including a first layer of material positioned between a second layer of material and a third layer of material;

wherein the first layer of material has a lower coefficient of friction than at least one of the second layer of material or the third layer of material.

2. The glove of claim 1 wherein the first layer of material has a lower coefficient of friction than the second layer of material and the third layer of material.

3. The glove of claim 1 wherein the first layer of material comprises polyethylene, polyester, or fiberglass.

4. The glove of claim 1 wherein the second layer of material comprises leather.

5. The glove of claim 1 wherein the first layer, the second layer, and the third layer are coextensive in shape and are stitched together along their respective perimeters.

6. The glove of claim 5 wherein among any two adjacent layers, there is not a glued or stitched connection within their respective perimeters.

7. The glove of claim 1 wherein the plurality of layers is retained in the palmar region via a stitched interface.

8. The glove of claim 1 wherein the palmar region includes at least one finger region.

9. A glove comprising:

a glove base configured to accommodate a users hand;

a first layer positioned on a palmar region of the glove base and attached to the glove base along a perimeter of the first layer; and a second layer positioned on the first layer, the second layer attached to the glove base along a perimeter of the second layer;

wherein the first layer has a first coefficient of friction less than a second coefficient of friction of at least one of the second layer or the glove base.

10. The glove of claim 9 wherein the first layer has a first coefficient of friction less than a second coefficient of friction of the second layer and less than a third coefficient of friction of the glove base.

11. The glove of claim 9 wherein the first layer comprises polyethylene, polyester, or fiberglass.

12. The glove of claim 9 wherein the glove base comprises leather.

13. The glove of claim 9 wherein the second layer is formed from a different material than the glove base.

14. The glove of claim 9 wherein the glove is a batting glove.

15. A batting glove comprising:

a plurality of material layers positioned in a palmar region of the glove, including:

a first material layer having a first coefficient of friction; and a second material layer positioned adjacent to a first side of the first material layer having a second coefficient of friction greater than the first coefficient of friction, wherein the first and second material layers are positioned to slide with respect to each other.

16. The batting glove of claim 15 wherein each of the plurality of material layers is shaped to conform to the palmar region including a finger region of the batting glove.

17. The batting glove of claim 15 wherein the first material layer is attached to the batting glove along a perimeter of the first material layer and not within the perimeter of the first material layer.

18. The batting glove of claim 15 further comprising a third material layer adjacent to a second side of the first material layer, the third material layer having a third coefficient of friction greater than the first coefficient of friction.

19. The batting glove of claim 15 wherein any two adjacent layers in the plurality of material layers are stitched or glued along their respective perimeters.

20. The batting glove of claim 15 wherein the first material layer comprises polyethylene, polyester, or fiberglass.

* * * * *